US005094458A

United States Patent [19]

Kamille

[11] Patent Number: 5,094,458

[45] Date of Patent: Mar. 10, 1992

[54] REDEMPTION SYSTEM FOR MULTI-PIECE GAMES

[76] Inventor: Stuart J. Kamille, P.O. Box 129, Glenbrook, Nev. 89413

[21] Appl. No.: 494,576

[22] Filed: Mar. 16, 1990

[51] Int. Cl.[5] ..... A63F 3/06; B42D 15/00

[52] U.S. Cl. ..... 273/240; 273/139; 283/901; 283/903; 283/100

[58] Field of Search ..... 273/240, 139, 269; 283/903, 901, 100, 101

[56] References Cited

U.S. PATENT DOCUMENTS 3,918,174 11/1975 Miller et al. ..... 273/139
4,087,092 5/1978 Krause et al. ..... 273/138 A
4,373,726 2/1983 Churchill et al. ..... 273/138 A
4,630,844 12/1986 Troy et al. ..... 283/100
4,669,729 6/1987 Solitt et al. ..... 273/138 A

FOREIGN PATENT DOCUMENTS 598964 12/1978 Switzerland ..... 273/139

*Primary Examiner*—Benjamin Layno
*Attorney, Agent, or Firm*—Brian C. Kelly

[57] ABSTRACT

The invention includes methods of secure redemption for use with and without automation, such that the redemption system is resistant to a dishonest redemption clerk using the system in reverse to locate a correct answer and use that information to defraud the game sponsor.

14 Claims, 3 Drawing Sheets

REDEMPTION SYSTEM FOR MULTI-PIECE GAMES

FIELD OF THE INVENTION

The present invention relates generally to a novel secure scoring and redemption system for multi-piece games and lotteries.

BACKGROUND OF THE INVENTION

In the lottery and multi-piece game art there can be a great deal of difficulty in assuring game security. Particularly in the case of promotional games which include a prize of some sort. Games like those disclosed in application Ser. No. 352,146 issued as Pat. No. 4,964,642 to KAMILLE which provide that any game piece can be a winner based upon the responses recorded by the player have the potential to be volatile from a security perspective.

Of course the lottery games have a great deal at risk if a perpetrator were to foist a fraudulent "winning" ticket on the sponsor.

The security of the lottery games has been protected by the fact that a particular subset of winners is segregated by their number. The only question arises in the context of a forgery. The KAMILLE games as set forth above present unique problems in redemption. First since the player is required to mark a response, this response must be checked for accuracy. Therein lies the problem, if the redemption is done in-house the number of different gamepieces causes a logistics problem and makes the opportunity to allow the redemption of a large number of smaller prizes more costly from the perspective of designation of a winner and shipment of a prize from a central location.

If the redemption is done in-store at multiple locations the logistics costs go down, and the susceptibility to a dishonest redemption clerk increases. The clerk might attempt to redeem losing tickets as winners or some how use the redemption system to anticipate the correct answer of other tickets.

OBJECTS OF THE INVENTION

Accordingly, it is a first object of the invention to provide a system by which a dishonest redemption clerk would not be able to anticipate a winning answer by using the redemption system in reverse.

A second object of the invention is to provide an efficient method for in-house redemption which keeps the redemption clerk blind to the correct answers for each of the gamepieces and overcomes the overwhelming problem posed by the number of different gamepieces through the use of automated techniques.

A third object of the invention is the introduction of a reliable secure in-store redemption system in order to allow a sponsor of a game to give prizes out at the store level rather than incuring the cost of determining winners and distributing individual prizes from a central location.

SUMMARY OF THE INVENTION

Briefly, the above and other objects are achieved by a method of secure redemption for multi-piece games including the steps of identifying a gamepiece to an automated system, retrieving information from an archive which corresponds to the identified gamepiece, recording a player response marked on the gamepiece in such a fashion that the computer can read it, and comparing for correllation the recorded response to that retrieved from the archive.

The invention also includes methods of secure redemption that might be used for an in-store redemption including the steps of removing void if unauthorizedly removed area to reveal a group of response verification characters used to verify the correct answer. In one embodiment a number corresponding to multiple possible answers only one of which is correct for each gamepiece, each answer corresponding to multiple numbers. In a second embodiment the group of response verification characters includes a grid of characters including among others the characters of the correct answer to the gamepiece.

DETAILED DESCRIPTION OF THE PREFERRED EMBODIMENT

Figure 1:
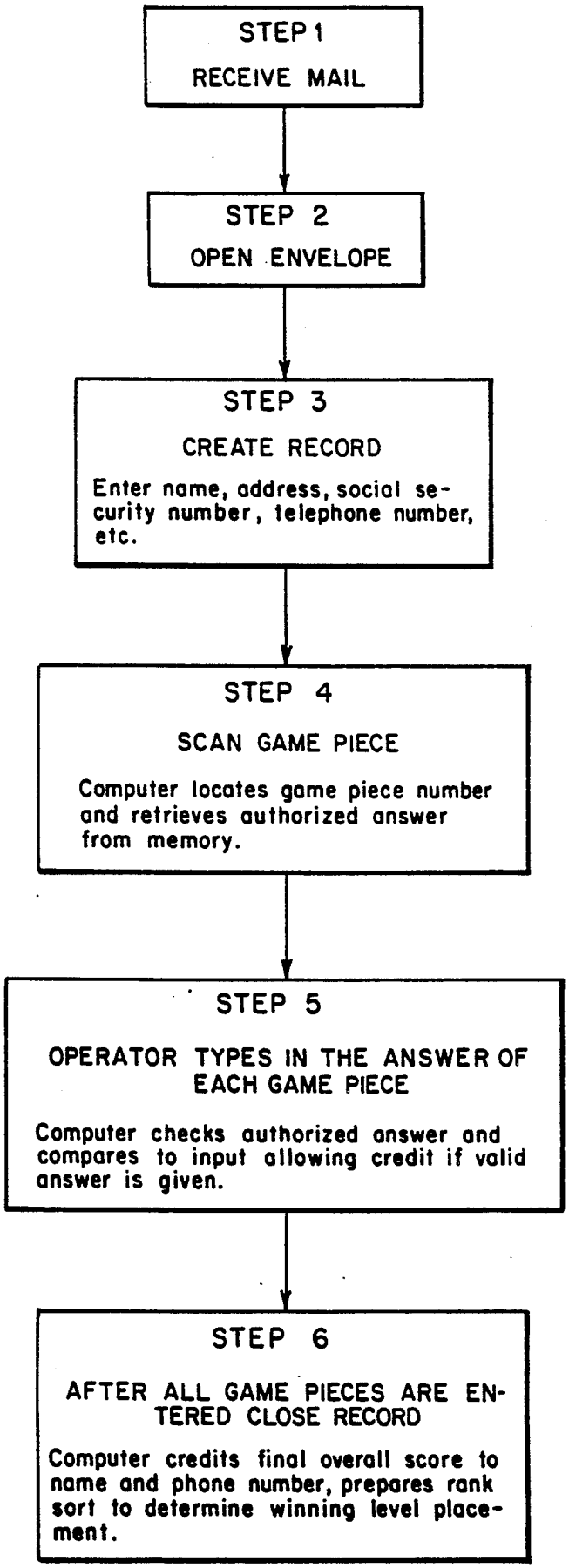
FIG. 1 is a block diagram depicting the steps of a method for automated secure redemption of multi-piece games.

Referring now to the drawings, wherein like reference numerals designate identical or corresponding parts throughout the several views, and more particularly to FIG. 1 which depicts the method for an in-house automated redemption system designed to reduce the opportunity for the operator to influence the redemption process. The mail is received in step 1 and the envelope is opened by a known opening device or manually in step 2. A player record including Name, Address, Social Security Number and Telephone Number are read off the gamepiece either manually or by a known optical character recognition system at step 3. In step 4 a computer scans a gamepiece using a bar code or like method in order to retrieve from memory the correct answer for the particular gamepiece. Simultaneously the computer scans the card to check number of clues revealed in the case of a variably score skill game gamepiece a described in the above referenced patent application.

In another embodiment the computer can scan the card for 19 integrity where the card is printed with a geometric grid in order to assure that the gamepiece has not been pieced together from other gamepieces or other materials.

In step 5 the answer written o the gamepiece is read by the operator and input to the system. The computer checks to see if the input matches the answer retrieved from memory. If the answer matches the score is tallied, else no score is tallied to the record made. This system is most efficient if many gamepieces are received in the same envelope so that the address and other information is not input repeatedly. In this embodiment after all the gamepieces for a record have been scanned a total is generated by the computer for all the scores credited to that record and compared to the scores required for different prizes.

The advantages of this system are that the operator never has to know the correct answer rather the operator is kept blind to the correct answer at all times.

Figure 2:
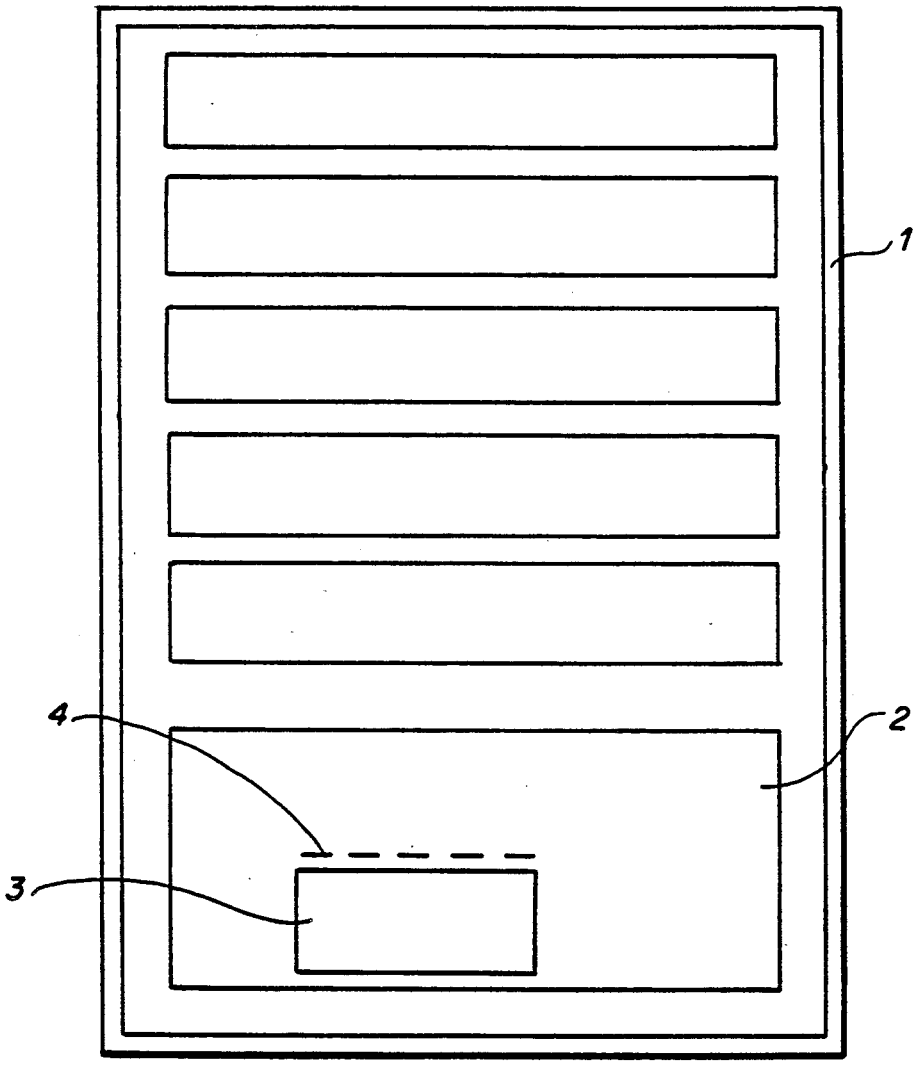
FIG. 2 is a representation of a gamepiece playing surface or card highlighting the void if removed area.
Figure 3:
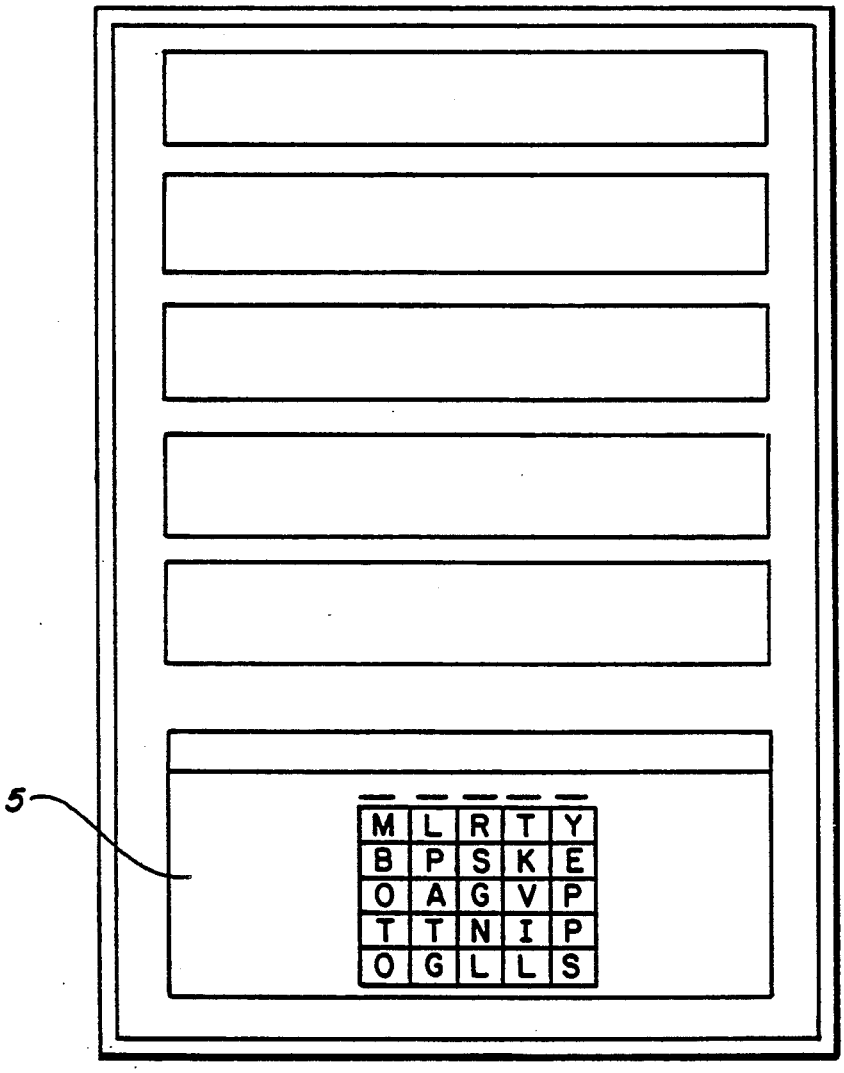
FIG. 3 is a representation of a gamepiece playing surface or card highlighting the void if removed area with the removable concealing means removed to show a grid of characters.

Another embodiment is presented because the computer equipment is relatively expensive for an in-store redemption application at this time, however as computer prices continue to come down the above system will make more financial sense. A more economical system of secure redemption is shown in FIGS. 2 and 3. In FIG. 2, 14 a gamepiece 1 is shown to include a player response area 2 and a "void if removed area"("vir") 3. The gamepiece shown is for an interactive game which requires the entry of a response by the player. The player response area also includes a group of blank spaces 4 equal in number or greater than the number of characters in the correct answer to the gamepiece. In FIG. 3 a removable concealing means such as the known rub and reveal materials has been removed from grid 5. The number of columns of grid 5 correspond to the number of blank spaces 4 and each column includes the correct corresponding character as well as a number of incorrect characters. Using this method the instore redemption clerk can easily compare the submitted answer against the grid. If all the letters are present in the columns in the corresponding order of appearance then the ticket is a winner. As for the security aspect, if a dishonest store clerk were to remove the vir area the clerk would be faced with a number of possible answers. The number being controlled by a judicious choice of incorrect characters. If a number of gamepieces were submitted to the sponsor for redemption with the wrong answer written on the player response area 2 then the sponsor could take action such as refusing to accept the gamepieces or the like. This could be determined by a random sampling check of all supposedly winning gamepieces received for collection by the store outlets.

Another embodiment uses the same structure as FIG. 2 except that under the vir area a number is printed rather than a grid of characters as in the above embodiment. The number will be included in a listing of numbers as corresponding to a number of different answers, each answer will appear under more than one number. If the answer presented in the player response area matches any of these answers then the ticket is a winner. If a dishonest redemption clerk were to remove the vir space he would not be able to trace the number to a single answer, however if he were to go even farther and sacrifice a card to determine the correct answer for a particular number that would not be of an assistance either, since each answer appears under a plurality of different numbers.

The embodiments as presented work best with an interactive multipleplay game which seeks to elicit a certain response like the above referenced patent application, however the techniques can be applied to a number of different game for secure redemption.

Obviously, numerous (additional) modifications and variations of the present invention ar possible in light of the above teachings. It is therefore to be understood that within the scope of the appended claims, the invention may be practiced otherwise than as specifically described herein.

What is claimed and desired to be secured by Letters Patent of the United States is:

1. A method of redemption for multi-piece games comprising the steps of identifying a game piece to an automated system, retrieving information from an archive which corresponds to said game piece, recording an interactive response generated by player from query printed on game piece said game piece in a manner readable by said automated system, comparing said recorded interactive response with those retrieved from said archive, designating a winning game piece if a said recorded interactive response corresponds to responses retrieved from said archive.

2. A method as described in claim 1 further comprising the step of:

scoring said gamepiece by recording a number of clues used on said gamepiece by the use of a manner readable by said automated system.

3. A method as described in claim 1 further comprising the step of:

recording player identification information in a manner readable by said automated system.

4. A method as described in claim 1 further comprising the step of:

checking the integrity of said gamepiece using optical character recognition means in comparing the background pattern of said gamepiece against that of a perfect game piece.

5. A method as described in claim 3 further comprising the step of:

tallying the total number of winning gamepieces for each respective player.

6. A method of secure redemption for a multi-piece game comprising the steps of:

removing removable concealing means from a "void-if-removed" area of said game piece exposing a group of response verification characters for verifying an interactive response generated by player from query printed on game piece marked on said game piece;

verifying an interactive response using said response verification characters.

7. A method as described in claim 6 wherein said response verification character comprise a number which corresponds to a group of possible player response.

8. A method as described in 7 wherein said step of verifying comprises retrieving said group of possible player responses from an archive and comparing said player response for a corelation.

9. A method as described in 6 wherein said group of response verification characters comprising a grid of characters such that the number of columns in said grid is not less that the number of characters in a correct response to said gamepiece.

10. A method as described in 9 wherein said step of verifying comprises locating each character of said player response in said column corresponding to each space in a player response area.

11. A gamepiece apparatus comprising of player response area for players to mark a proposed answer and a redemption verification system comprising a grid of characters.

12. An apparatus as described in claim 11 wherein said redemption verification system comprises an alphanumeric code printed on said gamepiece and concealed by removable concealing means.

13. An apparatus as described in claim 11 wherein in said redemption verification system further comprises a grid of characters such that the characters of a designated correct answer for said gamepiece is contained one character per column in said grid printed on said gamepiece and concealed by removable concealing means.

14. A method as described in claim 11 wherein said characters comprise pictographs.

* * * * *